US010781807B2

(12) United States Patent
Hannemann et al.

(10) Patent No.: US 10,781,807 B2
(45) Date of Patent: Sep. 22, 2020

(54) DOUBLE MEMBRANE FOR A DUST PUMP

(71) Applicant: Dipl. Ing. Ernst Schmitz GmbH & Co. KG Maschinen und Apparatebau, Toenisvorst (DE)

(72) Inventors: Frank Hannemann, Roettenbach (DE); Sebastian Rahm, Dresden (DE); Marcus Weder, Bannewitz OT Haenichen (DE)

(73) Assignee: Dipl. Ing. Ernst Schmitz GmbH & Co. KG Maschinen und Apparatebau, Toenisvorst (DE)

( * ) Notice: Subject to any disclaimer, the term of this patent is extended or adjusted under 35 U.S.C. 154(b) by 44 days.

(21) Appl. No.: 16/327,588

(22) PCT Filed: Aug. 22, 2017

(86) PCT No.: PCT/EP2017/071066
§ 371 (c)(1),
(2) Date: Mar. 5, 2019

(87) PCT Pub. No.: WO2018/036979
PCT Pub. Date: Mar. 1, 2018

(65) Prior Publication Data

US 2019/0195216 A1 Jun. 27, 2019

(30) Foreign Application Priority Data

Aug. 25, 2016 (DE) ..... 10 2016 216 006

(51) Int. Cl.
*F04B 43/00* (2006.01)
*F04B 43/06* (2006.01)
(Continued)

(52) U.S. Cl.
CPC ..... *F04B 43/009* (2013.01); *F04B 43/0054* (2013.01); *F04B 43/0081* (2013.01);
(Continued)

(58) Field of Classification Search
CPC .. F04B 43/009; F04B 43/067; F04B 43/0054; F04B 43/0081; F04B 43/02; F04B 43/06; F04B 45/0533; F04B 51/00; F04B 45/053
See application file for complete search history.

(56) References Cited

U.S. PATENT DOCUMENTS 3,131,638 A * 5/1964 Wilson ..... F04B 43/009 92/5 R
3,138,856 A 6/1964 Kuchek
(Continued)

FOREIGN PATENT DOCUMENTS

DE 427455 C 4/1926
DE 449676 C 9/1927
(Continued)

OTHER PUBLICATIONS

International Search Report dated May 2, 2017, for PCT/EP2016/081838.
(Continued)

*Primary Examiner* — Peter J Bertheaud
(74) *Attorney, Agent, or Firm* — Collard & Roe, P.C.

(57) ABSTRACT

A double membrane for a diaphragm pump for fluidizing, covering and conveying dusty products, such as, for example, pulverized coal, with the aid of an inert gas at pressures of up to 7 MPa, the diaphragm pump having a porous, curved loosening element made from aluminum, monitors and ensures the membrane tightness by designing the double membrane with an integrated pressure sensor for monitoring leakages. A hermetically tight separation between the hydraulic chamber and dust chamber of the diaphragm pump can therefore be ensured and damage to the membrane can be promptly identified. Complicated repair and cleaning measures of the entire dust system or hydraulic system in the event of membrane damage are prevented and the tightness of the membrane is maintained during the
(Continued)

incident. Particular refinements relate to the composition of the individual membranes and the interaction thereof.

6 Claims, 1 Drawing Sheet

(51) Int. Cl.
*F04B 43/02* (2006.01)
*F04B 51/00* (2006.01)
*F04B 45/053* (2006.01)

(52) U.S. Cl.
CPC ..... *F04B 43/02* (2013.01); *F04B 43/06* (2013.01); *F04B 45/053* (2013.01); *F04B 51/00* (2013.01)

(56) References Cited

U.S. PATENT DOCUMENTS

| | | | | |
|---|---|---|---|---|
| 3,605,566 | A * | 9/1971 | Vetter | F04B 43/009 92/5 R |
| 4,180,353 | A | 12/1979 | Geidies | |
| 4,818,191 | A | 4/1989 | Schlake | |
| 4,881,876 | A * | 11/1989 | Laziou | F04B 43/009 417/63 |
| 5,062,770 | A * | 11/1991 | Story | F04B 43/009 417/375 |
| 5,074,757 | A * | 12/1991 | Horn | F04B 43/009 417/63 |
| 5,188,515 | A * | 2/1993 | Horn | F04B 43/009 417/63 |
| 6,094,970 | A * | 8/2000 | Sprenger | F04B 43/009 417/63 |
| 6,447,216 | B1 | 9/2002 | Higuchi et al. | |
| 6,464,474 | B2 | 10/2002 | Schluecker | |
| 6,796,215 | B1 | 9/2004 | Hauser et al. | |
| 6,907,816 | B2 * | 6/2005 | Bubb | F04B 43/0054 92/5 R |
| 7,607,398 | B2 | 10/2009 | Tietze et al. | |
| 8,851,406 | B2 | 10/2014 | Sonwane et al. | |
| 9,138,672 | B2 | 9/2015 | Ehrich et al. | |
| 9,347,444 | B2 | 5/2016 | Nettesheim et al. | |
| 2007/0065308 | A1 | 3/2007 | Yamamoto et al. | |
| 2007/0074643 | A1 | 4/2007 | Tietze et al. | |
| 2010/0021247 | A1 | 1/2010 | Aldred et al. | |
| 2011/0100274 | A1 | 5/2011 | Kuske et al. | |
| 2011/0155662 | A1 | 6/2011 | Liu et al. | |
| 2012/0122042 | A1 | 5/2012 | Brueggemann et al. | |
| 2014/0037466 | A1 | 2/2014 | Nettesheim et al. | |
| 2014/0112802 | A1 | 4/2014 | Hannemann et al. | |
| 2017/0016440 | A1 * | 1/2017 | Stenbeck | F04B 51/00 |

FOREIGN PATENT DOCUMENTS

| | | | |
|---|---|---|---|
| DE | 485635 | C | 11/1929 |
| DE | 551066 | C | 5/1932 |
| DE | 568999 | C | 1/1933 |
| DE | 596565 | C | 5/1934 |
| DE | 615779 | C | 7/1935 |
| DE | 650988 | C | 10/1937 |
| DE | 656009 | C | 1/1938 |
| DE | 1008201 | B | 5/1957 |
| DE | 1175653 | B | 8/1964 |
| DE | 81606 | A1 | 4/1971 |
| DE | 2722931 | A1 | 11/1978 |
| DE | 147188 | A3 | 3/1981 |
| DE | 3035745 | A1 | 5/1982 |
| DE | 3909800 | A1 | 9/1990 |
| DE | 10 2005 047 583 | A1 | 4/2007 |
| DE | 102008007033 | A1 | 8/2009 |
| DE | 102008009679 | A1 | 8/2009 |
| DE | 102008049542 | A1 | 4/2010 |
| DE | 102008052673 | A1 | 4/2010 |
| DE | 102009016191 | A1 | 10/2010 |
| DE | 102008049542 | B4 | 12/2011 |
| DE | 10 2011 007 066 | A1 | 10/2012 |
| DE | 102011052432 | A1 | 10/2012 |
| DE | 102009016191 | B4 | 4/2013 |
| DE | 10 2012 216 084 | A1 | 3/2014 |
| DE | 202007019632 | U1 | 1/2015 |
| DE | 10 2014 212 919 | A1 | 1/2016 |
| DE | 10 2016 201 182 | A1 | 7/2017 |
| EP | 0 732 501 | A1 | 9/1996 |
| EP | 1 134 414 | A2 | 9/2001 |
| GB | 2004993 | A | 4/1979 |
| WO | 92/19866 | A1 | 11/1992 |
| WO | 01/14744 | A1 | 3/2001 |
| WO | 2009095290 | A2 | 8/2009 |
| WO | 2009095290 | A3 | 8/2009 |
| WO | 2010037601 | A1 | 4/2010 |

OTHER PUBLICATIONS

International Search Report of PCT/EP2017/071089, dated Nov. 17, 2017.
International Search Report of PCT/EP2017/071073, dated Dec. 6, 2017.
International Search Report of PCT/EP2017/071066, dated Dec. 5, 2017.
Industriepumpen + Kompressoren, "Prozesspumpen mit zustandsüberwachter redundanter Schlauchmembran-Einspannung" (with English translation of title page and Abstract of article)
Industry pumps + Compressors: Magazine for the praxis of pump and compressor technique, "Process pumps with condition-watched redundant hose membrane gripping," by Heinz M. Naegel, 16 year, brochure 3, 2010, pp. 120-123.

* cited by examiner

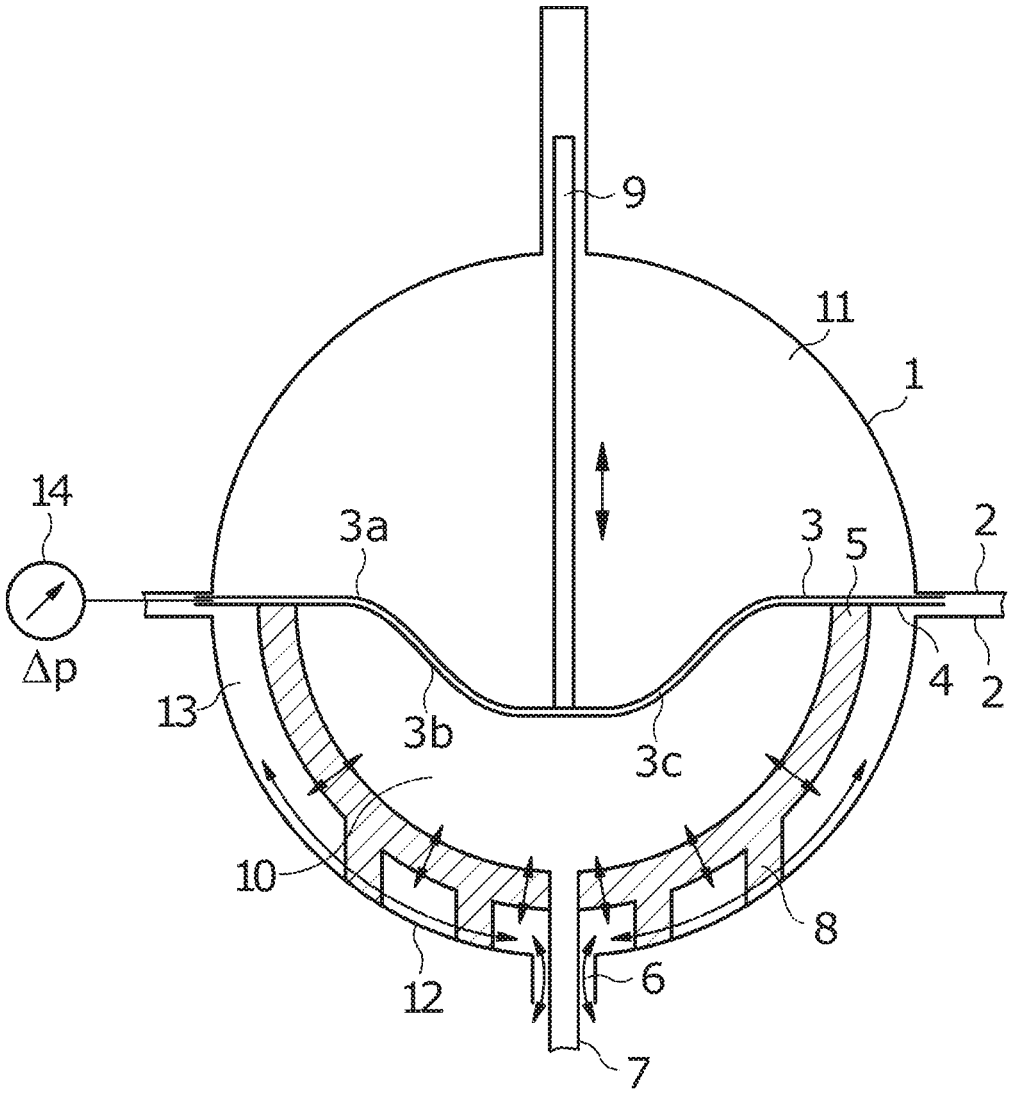
9
11
1
14
3a
3
5
2
Δp
13
3b
3c
4
2
10
8
12
6
7

DOUBLE MEMBRANE FOR A DUST PUMP

CROSS REFERENCE TO RELATED APPLICATIONS

This application is the National Stage of PCT/EP2017/071066 filed on Aug. 22, 2017, which claims priority under 35 U.S.C. § 119 of German Application No. 10 2016 216 006.0 filed on Aug. 25, 2016, the disclosures of which are incorporated by reference. The international application under PCT article 21(2) was not published in English.

BACKGROUND OF THE INVENTION

Field of the Invention

The invention relates to a double membrane for a pump for fluidizing, charging and conveying particulate products, such as coal dust, with the aid of inert gas at pressures of up to 7 MPa.

Description of the Related Art

Continuous and inexpensive dense phase conveying in the case of changing dust quality of combustible dusts for coal and biomass gasification plants is gaining increasingly in importance, in order, for example, to operate gasification plants more economically and with high availability. This objective is achieved in a special way with the use of a membrane pump, as proposed in patent application DE102016201182 of Jan. 27, 2016. Here, the particulate material to be conveyed is sucked into the membrane pump from below, is charged and fluidized in a next step, and is subsequently discharged under pressure. The residual gas volume in the dust space of the membrane pump is expanded in a last step after the discharging of the material to be conveyed, and the pump cycle starts over. On account of said cyclical (discontinuous) method of operation, a plurality of pump heads are usually connected together, in order to ensure continuous operation. For this purpose, the individual pump cycles are operated in a phase-shifted manner with respect to one another. Filter materials which satisfy the requirements of pressure-tightness and temperature resistance are, for example, the filtration fabrics, sintered metal and sintered plastic which are described in DE102012216084. The robust materials which are described are available only in a flat or plate-like structure and not in the required size or dimensions. Machining into other geometric shapes, such as curved half shells, is not possible on account of the required filter fineness and the damage or smearing of the porous filter structure which is produced during machining.

The special edition of "Industriepumpen+Kompressoren" [Industrial Pumps+Compressors], volume 16, issue 3-2010, pages 120-123, Vulkan-Verlag Essen with the title: "Prozesspumpen mit zustandsüberwachter redundanter Schlauchmembran-Einspannung" [Process pumps with state-monitored redundant tubular membrane clamping] by Heinz M. Nägel discloses a process pump, the double membrane of which is monitored for integrity by means of coupling fluid and a connection to a membrane rupture display.

SUMMARY OF THE INVENTION

The invention is based on the object of providing a membrane for a pump with an integrated filter element 5 for feeding swirl or charging gas into the pressure vessel of the pump, which membrane reconciles the requirements of pressure-tightness, temperature resistance, high operating reliability and high membrane availability.

The object is achieved by way of a membrane having the features of claim 1 according to the invention.

In accordance with the invention, monitoring and ensuring of the membrane tightness is provided. To this end, the membrane (3) is configured as a double membrane with an integrated pressure sensor for leak monitoring. In this way, a hermetically sealed separation between the hydraulic space (11) and the dust space (10) is ensured, and damage of the membrane is detected in a timely manner. Complex repair and cleaning measures of the entire dust system or hydraulic system are prevented in the case of membrane damage, and the tightness of the membrane is maintained during the malfunction.

The invention allows a structural design of the dust space, the contour of which is adapted particularly advantageously to the deflection of the membrane and possibly to the guide rod of the membrane. As a result, uniform and reversible deformation of the membrane with wear which is as low as possible is achieved.

After conclusion of the discharging operation of the membrane pump, largely flat bearing of the membrane (3) against the curved, half shell-shaped loosening face (5) can be achieved. A small dead volume can be achieved by way of said advantageous design, which leads to a minimum dust space volume (10) with at the same time a high conveying quantity and a small high pressure gas loss.

Advantageous developments of the invention are discussed below.

BRIEF DESCRIPTION OF THE DRAWINGS

The sole FIGURE shows a membrane pump according to the invention.

DETAILED DESCRIPTION OF PREFERRED EMBODIMENTS

In the following text, the invention will be described as an exemplary embodiment in greater detail to an extent which is required for comprehension, using the sole FIGURE.

The membrane pump which is shown in the sole FIGURE is an apparatus which consists of two pressure-tight half shells (1, 12) and are connected to one another in a gas-tight manner via a flange connection (2). In addition to a simple dismantling option of the dust pump, the flange connection has the additional function of fastening and clamping the membrane (3) and the loosening face (5) via a filter flange (4). Therefore, by way of the spherical geometry, an advantageous deflection of the membrane into the dust space can take place in the form of a rotational paraboloid, which deflection is gentle for the filter material. Here, the deflection of the membrane is brought about by way of an action of force of the hydraulic liquid, such as described in DE102016201182. Abrupt changes are avoided and, after conclusion of the discharging operation of the membrane pump, largely flat bearing of the membrane (3) against the half shell-shaped loosening face (5) can be achieved. A small dead volume can be achieved by way of said advantageous design, which leads to a minimum dust space volume (10) with at the same time a high conveying quantity and a small high pressure gas loss. In order to avoid undesired movements and folds during the discharging operation, the movement of the membrane is guided and stabilized via a guide rod (9). In one particularly advantageous embodiment, the guide rod can undertake additional tasks, such as a positional determination of the membrane via metrological position transmitters.

Furthermore, the invention is based on the problem of producing dense phase conveying, described in DE 102005047583, by way of generation of a swirl layer within the dust space. This is ensured during the charging and discharging operation by homogeneous gas feeding via a half shell-shaped loosening face (5) of gas-permeable configuration. Porous metal, for example aluminum, with a sufficiently small pore size and filter fineness of <20 μm is used as filter material for the loosening face (5). This can ensure that very fine dust particles do not penetrate into the loosening face during the expansion operation. For the production of porous metal, liquid metal, for example aluminum, is poured together with granulated salt into a half shell mold. Salt has a substantially higher melting point, for example, in comparison with metals such as aluminum, and does not pass into the liquid material phase, but rather is distributed uniformly in the molten material. After solidification of the metal, the salt is rinsed out with the aid of a salt-dissolving liquid, and porous and gas-permeable metal is produced. One advantage of said method consists in the possibility of carrying out machining before rinsing out of the salt crystals. Smearing of the pores is ruled out as a result. The required porosity and filter fineness are set via the size of the salt grains.

In one special refinement of the invention, the hydraulic half shell (1) has a smaller internal diameter than the internal diameter of the dust half shell (12). The curved loosening face (5) can be fixed by way of said structural measure.

In order to achieve an advantageous flange seal (2), the loosening face (5) can be configured as a half shell with a flange edge in a manner which is formed in two layers, as a porous metal in the lower region and made from solid material in the flange region.

In one special refinement of the invention, the half shell-shaped casting mold of the loosening face (5) is augmented with additional annular and/or punctiform supporting elements (8). In this way, the half shell-shaped loosening face (5) which consists of porous metal can be fitted and fastened into the lower pressure-tight half shell (12) which consists of solid material. A gas space 13 is advantageously produced between the loosening face which consists of porous metal and the pressure-tight half shell, which gas space 13 can be used for the distribution of the loosening and charging gas. The feeding and discharging of the loosening and charging gas take place via openings 6 in the lower pressure-tight half shell 12.

In the case of a hydraulically driven membrane pump for pneumatic high pressure conveying of fluidized dusts, particular importance is attached to the reliable sealing of the dust space from the hydraulic space which are separated by way of the membrane. The deflection of the membrane and the associated intake and discharging of the particulate material to be conveyed is achieved by way of the hydraulic liquid being pushed in and out in the hydraulic space which is situated above the membrane. In the context of said conveying operation, the penetration of dust into the hydraulic liquid or of hydraulic liquid into the dust space is associated with considerable plant malfunctions and would lead to complex repairs.

In the case of an embodiment of the membrane 3 as a double membrane, two elastomeric membranes (first and second elastic layers 3*a*, 3*b*) are arranged such that they are supported mechanically against one another, in such a way that a closed intermediate space containing a medium 3*c* which can be monitored by means of a pressure sensor Δp (14) is formed between the membranes. During malfunction-free operation, the intermediate space is at a pressure which is lower than the pressure in the hydraulic space or the dust space. If a pressure rise is then determined in the intermediate space, a leak of one of the two membranes of the double membrane is indicated. The two membranes can be arranged such that they are supported mechanically against one another in a punctiform manner by virtue of the fact that a layer of balls is arranged between them. The two membranes can be arranged such that they are supported mechanically against one another by virtue of the fact that a coupling liquid which is operatively connected to the pressure sensor Δp is introduced between them.

The elastomeric membrane can be formed by way of an elastomer or a solid PTFE mixture. In the case of the double membrane, one of the two membranes can be produced by way of an elastomer and the other of the two membranes can be produced by way of a solid PTFE mixture.

The invention is also produced by way of a membrane pump for fluidizing and conveying dusts, in the case of which membrane pump

- the pressure-tight housing of the dust pump consists of two half shells which are connected by way of a flange connection and into which a membrane and loosening face are flange-connected,
- the loosening face is configured in layers from porous material in the lower region and solid material in the region of the flange connection,
- the loosening face is configured as a half shell, comprises supporting elements, and a gas space exists between the pressure-resistant lower half shell and the loosening face.

For illustrative purposes, the present invention has been described in detail using specific exemplary embodiments. Here, elements of the individual exemplary embodiments can also be combined with one another. The invention is therefore not to be restricted to individual exemplary embodiments, but rather are restricted merely by way of the appended claims.

LIST OF DESIGNATIONS

1. Pressure-tight upper half shell, hydraulic half shell
2. Container flange
3. Membrane
3*a*. First elastic layer
3*b*. Second elastic layer
3*c*. Medium
4. Filter flange
5. Loosening face consisting of porous metallic filter material
6. Openings for charging and conveying gas, gas pipe
7. Inner pipe for inlet and outlet of the dust, dust pipe
8. Annular, punctiform, strip-shaped supporting elements
9. Membrane guide/guide rod
10. Dust space
11. Hydraulic space
12. Pressure-tight lower half shell, dust half shell
13. Gas space
14. Pressure sensor Δp

The invention claimed is:

1. A membrane, comprising:

a pressure-resistant housing comprising pressure-resistant first and second half shells;

a flange connection connecting the first and second half-shells to each other in a gas-tight manner;

a double membrane fastened and clamped within the first and second half-shells; and a loosening face fastened and clamped within the second half-shell via the flange connection;

wherein the double membrane comprises a first elastic layer and a second elastic layer, between which a medium lies;

wherein the medium is operatively connected to a pressure sensor for leak monitoring; and wherein the loosening face is constructed in layers from porous material in a lower region and from solid material in a region of the flange connection, the loosening face comprising a third half-shell and a gas space being disposed between the second half-shell and the loosening face.

2. The membrane pump as claimed in claim 1, wherein the double membrane has a flange edge for flange-connecting within the flange connection.

3. The membrane pump as claimed in claim 1, wherein the medium is provided by way of a coupling liquid.

4. The membrane pump as claimed in claim 1, wherein the first elastic layer is formed by way of an elastomer, and the second elastic layer is formed by way of a solid PTFE mixture.

5. The membrane pump as claimed in claim 1, wherein the double membrane is guided by way of a central guide rod.

6. The membrane pump as claimed in claim 1, wherein the loosening face contains at least one of annular elements and punctiform support elements.

* * * * *